US009829211B2

(12) United States Patent
Zhang et al.

(10) Patent No.: US 9,829,211 B2
(45) Date of Patent: Nov. 28, 2017

(54) AIR DEFLECTOR DRIVING DEVICE AND INDOOR AIR-CONDITIONING UNIT USING DRIVING DEVICE

(71) Applicant: Gree Electric Appliances, Inc. of Zhuhai, Zhuhai, Guangdong (CN)

(72) Inventors: Hui Zhang, Guangdong (CN); Shaolin Chen, Guangdong (CN); Xianlin Wang, Guangdong (CN); Zhi Meng, Guangdong (CN)

(73) Assignee: GREE ELECTRIC APPLIANCES, INC. OF ZHUHAI, Zhuhai, Guangdong (CN)

( * ) Notice: Subject to any disclaimer, the term of this patent is extended or adjusted under 35 U.S.C. 154(b) by 586 days.

(21) Appl. No.: 14/380,879

(22) PCT Filed: Feb. 1, 2013

(86) PCT No.: PCT/CN2013/071287

§ 371 (c)(1),
(2) Date: Aug. 25, 2014

(87) PCT Pub. No.: WO2013/127290

PCT Pub. Date: Sep. 6, 2013

(65) Prior Publication Data

US 2015/0011155 A1 Jan. 8, 2015

(30) Foreign Application Priority Data

Feb. 29, 2012 (CN) ..... 2012 2 0070564 U

(51) Int. Cl.
*F24F 7/00* (2006.01)
*F24F 13/06* (2006.01)
(Continued)

(52) U.S. Cl.
CPC ..... *F24F 13/08* (2013.01); *F24F 1/0011* (2013.01); *F24F 13/1426* (2013.01); *F24F 2013/1446* (2013.01)

(58) Field of Classification Search
CPC .... F24F 13/08; F24F 13/1426; F24F 13/1406; F24F 1/0011; F24F 2013/1433; F24F 2013/1446; F24F 7/04
See application file for complete search history.

(56) References Cited

U.S. PATENT DOCUMENTS 5,782,688 A * 7/1998 Baek ..... F24F 1/0011 454/233
6,415,622 B2 * 7/2002 Kim ..... F24F 1/0011 62/408

(Continued)

FOREIGN PATENT DOCUMENTS

CN 201246855 Y * 5/2009
JP 2009210207 A * 9/2009

*Primary Examiner* — Steven B McAllister
*Assistant Examiner* — Jonathan Cotov
(74) *Attorney, Agent, or Firm* — Li&Cai Intellectual Property (USA) Office

(57) ABSTRACT

Disclosed is an air deflector driving device, comprising a driving case and connecting rod (3). One side of the driving case is provided with a protruding opening (11), the connecting rod (3) is slidably provided in the driving case, and a tip (31) of the connecting rod (3) is limited in the direction perpendicular to the direction of movement of the connecting rod by means of the limiting structure. Furthermore, also disclosed is an indoor air conditioning unit using the driving device.

13 Claims, 3 Drawing Sheets

(51) Int. Cl.

| | |
|---|---|
| ***F24F 13/08*** | (2006.01) |
| ***F24F 13/14*** | (2006.01) |
| ***F24F 1/00*** | (2011.01) |

(56) References Cited

U.S. PATENT DOCUMENTS

| | | | | |
|---|---|---|---|---|
| 7,530,189 | B2 * | 5/2009 | Kim | F24F 1/0007 40/725 |
| 7,607,251 | B2 * | 10/2009 | Kim | F24F 1/0007 40/711 |
| 7,670,414 | B2 * | 3/2010 | Cha | B01D 46/12 55/418 |
| 7,878,017 | B2 * | 2/2011 | Yasutomi | F24F 1/0007 236/91 D |
| 8,074,462 | B2 * | 12/2011 | Yasutomi | F24F 1/0007 62/262 |
| 8,534,092 | B2 * | 9/2013 | Lee | F24F 1/0007 62/428 |
| 8,715,047 | B2 * | 5/2014 | Kim | F24F 1/0007 454/248 |
| 9,347,699 | B2 * | 5/2016 | Huang | F24F 1/0011 |
| 2002/0189274 | A1 * | 12/2002 | Lee | F24F 1/0007 62/298 |
| 2007/0140831 | A1 * | 6/2007 | Pong | F04D 17/04 415/52.1 |
| 2007/0151286 | A1 * | 7/2007 | Park | F24F 1/48 62/509 |
| 2011/0197512 | A1 * | 8/2011 | Nomura | B60H 1/00692 49/70 |

* cited by examiner

AIR DEFLECTOR DRIVING DEVICE AND INDOOR AIR-CONDITIONING UNIT USING DRIVING DEVICE

TECHNICAL FIELD

The present invention relates to an air conditioner, and particularly to an air deflector driving device and an indoor air-conditioning unit using the driving device.

BACKGROUND OF THE ART

A general indoor air-conditioning unit is provided with an air deflector member for guiding the up and down blowing directions of air and an air deflector driving device for driving the air deflector member to rotate.

Currently, the air deflector driving device is mainly composed of a driving case, a connecting rod and a motor, wherein the connecting rod is slidably disposed in the driving case, with its tail connected with the motor through a gear-rack transmission mechanism and its tip connected with the air deflector. It is found during use that the connecting rod has relatively poor stability during telescoping movement, causing the air deflector member incapable of working stably.

SUMMARY OF THE INVENTION

The first technical problem to be solved by the present invention is to provide an air deflector driving device capable of increasing the stability of the movement of the connecting rod, making the air deflector work stably.

The second technical problem to be solved by the present invention is to provide an indoor air-conditioning unit with its connecting rod working stably, making the air deflector work stably.

The present invention solves the first technical problem by an air deflector driving device comprising a driving case and a connecting rod, wherein one side of the driving case is provided with a protruding opening, the connecting rod is slidably provided in the driving case, the tip of the connection rod protrudes from the protruding opening, the driving case is provided therein with a limiting structure by means of which the displacement of the connecting rod in the direction perpendicular to the moving direction of the connecting rod is limited.

In a preferred embodiment, the limiting structure comprises a first limiting member and a second limiting member, with the first limiting member and the second limiting member close to the protruding opening and located at either side of the connecting rod respectively.

In a preferred embodiment, the first limiting member and the second limiting member each comprises a pillar and a rolling member sleeved over the pillar, and the rolling member is provided with a limiting groove matching with the edge of the connection rod.

In a preferred embodiment, the rolling member is constituted by two stepped bearing pads.

In a preferred embodiment, the connection rod is provided at its tail with a chute guide rail extending along the moving direction of the connecting rod;

the limiting structure comprises a third limiting member and a fourth limiting member, the third limiting member is arranged to pass through the chute guide rail and cooperate therewith, and the fourth limiting member is provided on a side of the connecting rod opposite to the third limiting member.

In a preferred embodiment, the third limiting member and the fourth limiting member each comprises a pillar and a rolling member sleeved over the pillar, and the rolling member is provided with a limiting groove matching with the edge of the connection rod.

In a preferred embodiment, the rolling member is constituted by two stepped bearing pads.

In a preferred embodiment, the limiting structure further comprises at least one limiting post provided along the moving direction of the connecting rod, a slide groove running through the surface of the connecting rod is provided on the surface of a side of the connecting rod facing the limiting post, and the limiting post is in cooperation with the slide groove.

In a preferred embodiment, the driving case comprises a case body and a case cover in snap-fit, and the limiting structure is provided on the case body.

The present invention solves the second technical problem by an indoor air-conditioning unit comprising an air deflector and an air deflector driving device as mentioned above, wherein the tip of the connecting rod is connected with the air deflector.

Compared to the prior art, the present invention has the following advantages:

With the air deflector driving device of the present invention, the driving case is provided therein with a limiting structure by means of which the displacement of the connecting rod in up, down, left and right directions during movement is limited, such that the connecting rod can run stably according to the preset trajectory during the telescoping movement, thus achieving the stable working of the air deflector.

BRIEFLY DESCRIPTION OF DRAWINGS

Explanation of Reference Numbers: 1—case body; 11—protruding opening;

12, 13, 14, 15—pillar; 16, 17—limiting post; 2—case cover; 3—connecting rod; 31—head end of the connecting rod; 32—tail end of the connecting rod; 33—rack; 34—chute guide rail; 35—slide groove; 36—edge of the connecting rod; 4—main gear; 5—bearing pad; 6—limiting groove; A—first limiting member; B—second limiting member; C—third limiting member; D—fourth limiting member.

DETAIL OF EMBODIMENTS

Hereinafter, the embodiments of the present invention will be described in detail, referring to the figures.

Figure 1:
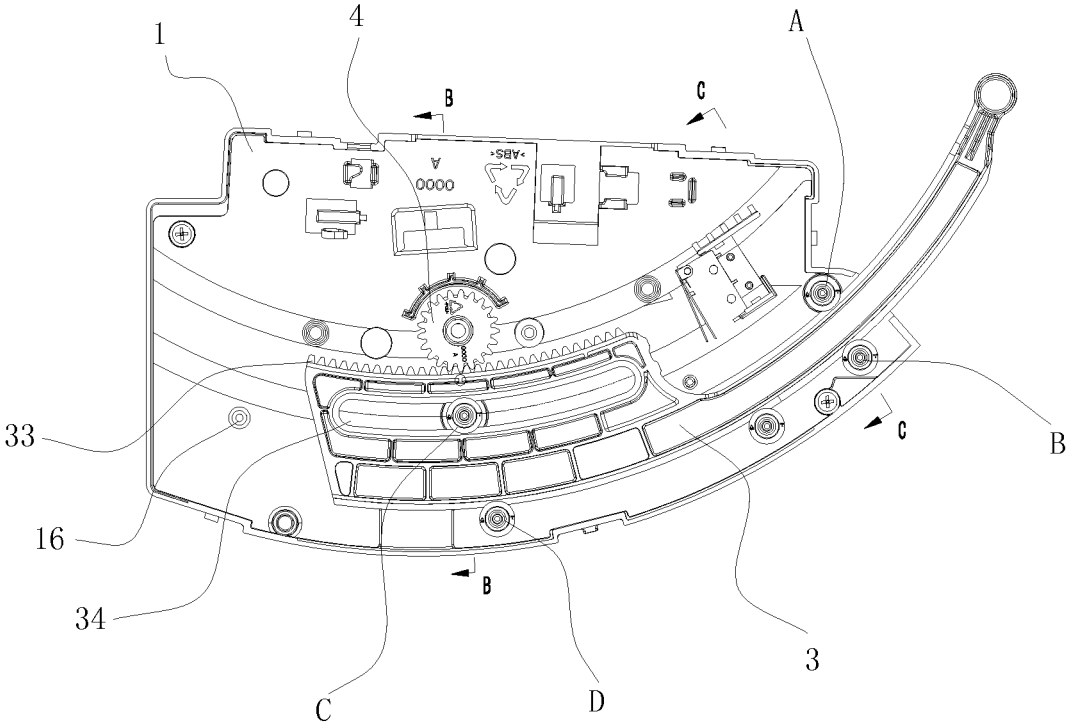
FIG. 1 is a structural schematic view of the air deflector driving device in an embodiment of the present invention.
Figure 2:
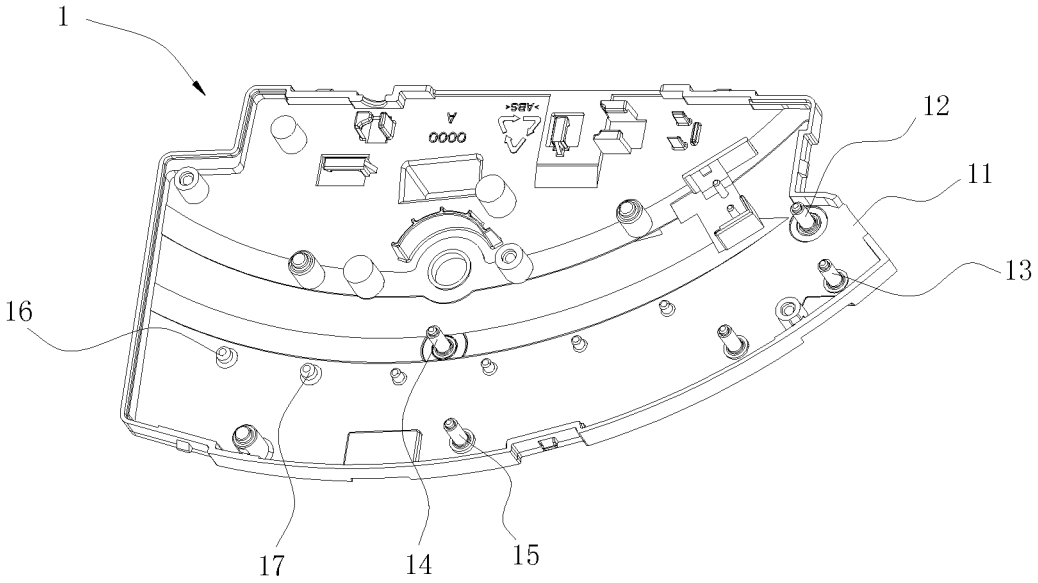
FIG. 2 is a prospective schematic view of the case body of the air deflector driving device shown in FIG. 1.

Referring to FIGS. 1 and 2, in one embodiment of the present invention, the connecting rod limiting means is mainly composed of a driving case and a limiting structure provided in the driving case. The driving case is constituted of a case body 1 and a case cover 2. The case body 1 is provided with a protruding opening 11 and the limiting structure. The connecting rod 3 is slidably provided in the driving case. The tail end 32 of the connecting rod is provided with a rack 33 which is engaged with a main gear 4 mounted in the driving case, and the tip end 31 of the connecting rod protrudes from the protruding opening 11. The telescoping movement of the connecting rod 3 is achieved by means of the forward and backward rotation of a motor. The displacement of the connecting rod 3 in the up, down, left and right directions during the movement is limited by means of the limiting structure, such that the connecting rod 3 can stably work during the telescoping movement, achieving the stable working of the air deflector. The limiting structure of the present embodiment can be divided to three limiting points: first, second and third limiting points.

Figure 3:
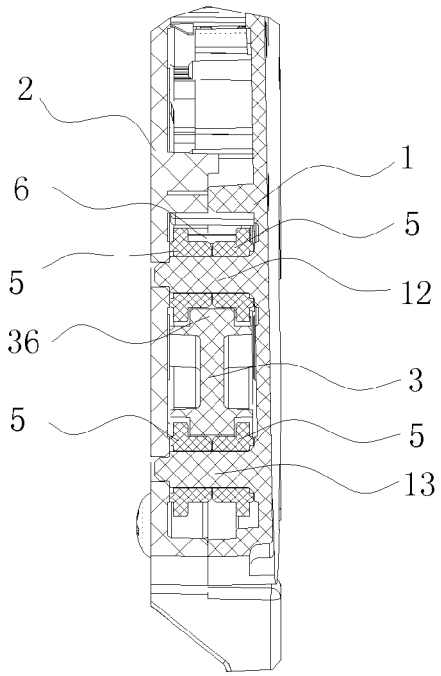
FIG. 3 is a sectional view along line C-C in FIG. 1.

Referring to FIG. 1, the first limiting point is composed of a first limiting member A and a second limiting member B each of which is close to the protruding opening 11 and located on either side of the connecting rod 3 respectively. Further referring to FIG. 3, the first limiting member A is composed of a pillar 12 and a rolling member sleeved over the pillar 12. The rolling member is provided with a limiting groove 6 matching with the edge of the connecting rod 3. The first limiting member A and the second limiting member B respectively limit the up and down displacements of the connecting rod 3 during the movement from both sides, making it work stably. Meanwhile, after the case body 1 and the case cover 2 are snapped together, the limiting groove 6 limits the movement of the connecting rod 3 towards the left and right directions during the movement, in order to avoid the connecting rod 3 swaying leftward and rightward. Preferably, the rolling member is constituted by two stepped bearing pads 5. During assembly, firstly a bearing pad 5 is mounted onto the pillar 12 on one side, then the connecting rod 3 is mounted into the case body 1, and subsequently a bearing pad 5 is mounted on the other side, so as to facilitate the assembly. The second limiting member B, which has the same structure as the first limiting member A, is composed of a pillar 13 and two bearing pads 5 sleeved over the pillar 13. The redundant description is omitted.

Figure 4:
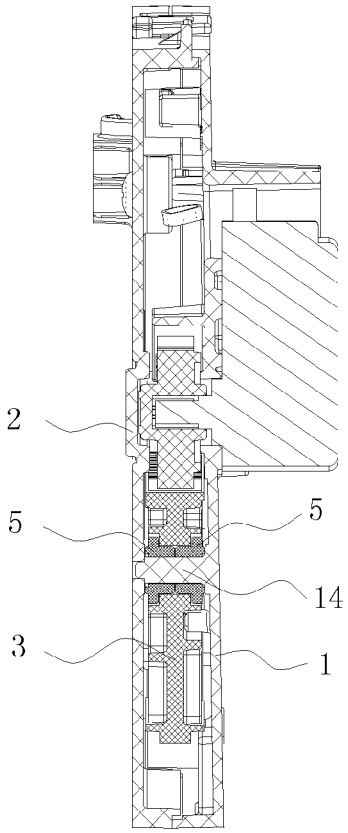
FIG. 4 is a sectional view along line B-B in FIG. 1.

The second limiting point is composed of a third limiting member C and a fourth limiting member D. The tail of the connecting rod 3 is provided with a chute guide rail 34 extending along the moving direction of the connecting rod 3. The third limiting member C is arranged to pass through the chute guide rail 34 and cooperation therewith. The fourth limiting member D is provided on the lower side of the connecting rod 3 opposite to the third limiting member C. The third limiting member C and the fourth limiting member D limit in combination the upward and downward displacements of the connecting rod 3 during the movement. Referring to FIG. 4, the third limiting member C, which has the same structure as the first limiting member A, is composed of a pillar 14 and two bearing pads 5 sleeved over the pillar. The third limiting member C, which has the same structure as the first limiting member A, is composed of a pillar 15 and two bearing pads 5 sleeved over the pillar. The redundant description is omitted.

Figure 5:
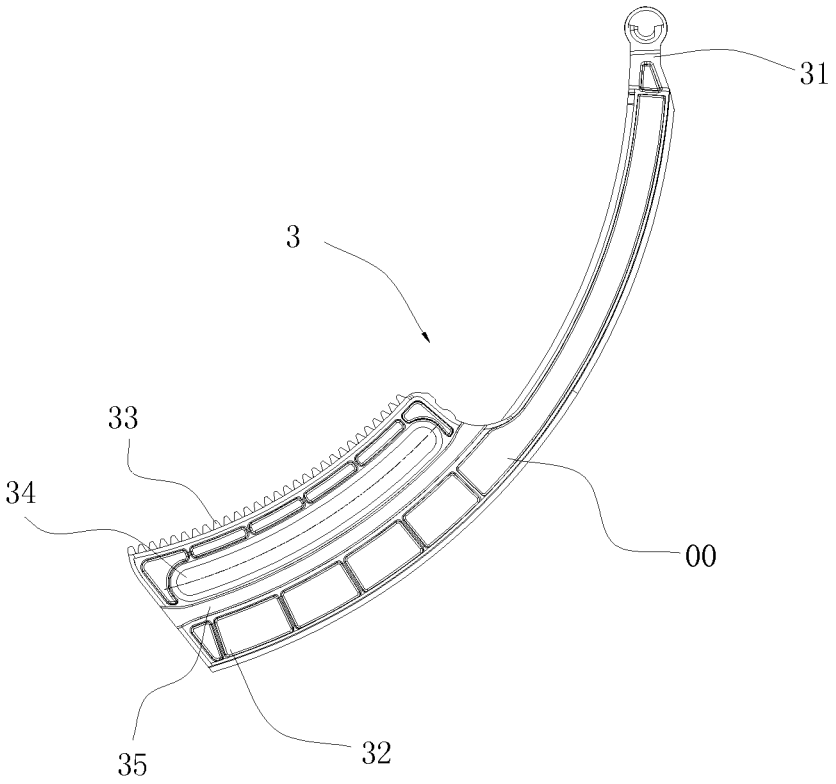
FIG. 5 is a prospective schematic view of the connecting rod of the air deflector driving device shown in FIG. 1.

The third limiting point is composed of two limiting posts 16 and 17 arranged as being spaced along the moving direction of the connecting rod 3. Referring to FIG. 5, a slide groove 35 running through the surface of the connecting rod 3 is provided on the surface of a side of the connecting rod 3 facing the limiting posts 16 and 17, and the limiting posts 16 and 17 are in cooperation with the slide groove 35, in order to limit the position in up and down direction and support the tail end of the connecting rod 3.

Hereinafter, the working principle of the present embodiment is further described.

During the movement of the connecting rod 3, the telescoping trajectory of the connecting rod 3 is based on a preset track. When the connecting rod 3 is protruding out, the main gear 4 rotates to drive the rack 3 to move, and at the same time, the bearing pads 5 rotate and the pillars 12, 13, 14, and 15 limit the position in up and down direction of the connecting rod 3, making it work stably. The moving angle is controlled by the rotating angle of the stepping motor which is controlled by a preset program. When protruding to rotate to a certain angle, the connecting rod is stopped. When the connecting rod 3 moves to the front half portion, the first limiting point and the second limiting point assure in combination the position in up and down direction of the connecting rod 3 and prevent it from playing and being displaced leftwards and rightwards, such that it protrudes smoothly, up to the extreme position.

After the connecting rod 3 protrudes to the extreme position, a microswitch is triggered to make the motor rotate reversely, so as to drive the main gear 4 to rotate reversely. When the connecting rod 3 contracts to the rear half portion, the stability of the rear portion of the connecting rod 3 is achieved by means of the second limiting point and the third limiting point which limit in combination the movement in the up and down direction. At the same time, the front end of the connecting rod 3 is still limited by the first limiting point.

Obviously, with the limiting means of the connecting rod 3, the connecting rod 3 is limited by the three limiting points in combination, guaranteeing the connecting rod 3 stable in left, right, up and down directions.

The above description only relates to specific embodiments of the present invention, is not intended to limit the protection scope of the present invention.

Without departing the concept of the present invention, any substitutions and improvements are covered by the protection scope of the present invention.

What is claimed is:

1. An air deflector driving device, comprising a driving case and a connecting rod, wherein one side of the driving case is provided with a protruding opening, the connecting rod is slidably provided in the driving case, the tip of the connection rod protrudes from the protruding opening, wherein the driving case is provided therein with a limiting structure by means of the connecting rod is based on a preset track; the limiting structure comprises a first limiting member and a second limiting member, with the first limiting member and the second limiting member close to the protruding opening and located at either side of the connecting rod respectively; the first limiting member and the second limiting member each comprises a pillar and a rolling member sleeved over the pillar, and the rolling member is provided with a limiting groove matching with the edge of the connection rod.

2. The air deflector driving device according to claim 1, wherein the rolling member is constituted by two stepped bearing pads.

3. The air deflector driving device according to claim 2, wherein the limiting structure further comprises at least one limiting post provided along the moving direction of the connecting rod, a slide groove running through the surface of the connecting rod is provided on the surface of a side of the connecting rod facing the limiting post, and the limiting post is in cooperation with the slide groove.

4. The air deflector driving device according to claim 1, wherein the connection rod is provided at its tail portion with a chute extending along the moving direction of the connecting rod; the limiting structure comprises a third limiting member and a fourth limiting member, the third limiting member is arranged to pass through the chute and cooperate therewith, and the fourth limiting member is provided on a side of the connecting rod opposite to the third limiting member.

5. The air deflector driving device according to claim 4, wherein the third limiting member and the fourth limiting member each comprises a pillar and a rolling member sleeved over the pillar, and the rolling member is provided with a limiting groove matching with the edge of the connection rod.

6. The air deflector driving device according to claim 5, wherein the rolling member is constituted by two stepped bearing pads.

7. The air deflector driving device according to claim 6, wherein the limiting structure further comprises at least one limiting post provided along the moving direction of the connecting rod, a slide groove running through the surface of the connecting rod is provided on the surface of a side of the connecting rod facing the limiting post, and the limiting post is in cooperation with the slide groove.

8. The air deflector driving device according to claim 5, wherein the limiting structure further comprises at least one limiting post provided along the moving direction of the connecting rod, a slide groove running through the surface of the connecting rod is provided on the surface of a side of the connecting rod facing the limiting post, and the limiting post is in cooperation with the slide groove.

9. The air deflector driving device according to claim 4, wherein the limiting structure further comprises at least one limiting post provided along the moving direction of the connecting rod, a slide groove running through the surface of the connecting rod is provided on the surface of a side of the connecting rod facing the limiting post, and the limiting post is in cooperation with the slide groove.

10. The air deflector driving device according to claim 1, wherein the limiting structure further comprises at least one limiting post provided along the moving direction of the connecting rod, a slide groove running through the surface of the connecting rod is provided on the surface of a side of the connecting rod facing the limiting post, and the limiting post is in cooperation with the slide groove.

11. The air deflector driving device according to claim 10, wherein the driving case comprises a case body and a case cover in snap-fit, and the limiting structure is provided on the case body.

12. An indoor air-conditioning unit, comprising an air deflector and an air deflector driving device according to claim 1, wherein the tip of the connecting rod is connected with the air deflector.

13. An air deflector driving device, comprising a driving case and a connecting rod, wherein one side of the driving case is provided with a protruding opening, the connecting rod is slidably provided in the driving case, the tip of the connection rod protrudes from the protruding opening, wherein the driving case is provided therein with a limiting structure by means of which the connecting rod is based on a preset track; the limiting structure further comprises at least one limiting post provided along the moving direction of the connecting rod, a slide groove running through the surface of the connecting rod is provided on the surface of a side of the connecting rod facing the limiting post, and the limiting post is in cooperation with the slide groove.

* * * * *